United States Patent [19]

Lanham

[11] 4,380,888

[45] Apr. 26, 1983

[54] MOUTHPLATE FOR HORSES OR THE LIKE

[75] Inventor: Dennie C. Lanham, Southern Pines, N.C.

[73] Assignee: Raymond M. Williams, Southern Pines, N.C.

[21] Appl. No.: 238,990

[22] Filed: Feb. 27, 1981

[51] Int. Cl.[3] ..... B68B 7/00; A61D 5/00

[52] U.S. Cl. ..... 54/8; 433/1

[58] Field of Search ..... 54/7, 8, 9; 128/136; 433/6, 167, 190, 213, 1

[56] References Cited

U.S. PATENT DOCUMENTS

| | | | |
|---|---|---|---|
| 312,182 | 2/1885 | Brott et al. | 54/8 |
| 420,721 | 2/1890 | Fancher | 54/7 |
| 2,643,652 | 6/1953 | Cathcart | 128/136 |
| 2,685,133 | 8/1954 | Greene et al. | 433/213 |
| 3,434,470 | 3/1969 | Strickland | 128/136 |

FOREIGN PATENT DOCUMENTS

| | | | |
|---|---|---|---|
| 17401 | 7/1896 | United Kingdom | 54/7 |

*Primary Examiner*—Robert P. Swiatek

[57] ABSTRACT

A mouthplate is disclosed which includes a support member having a depending flange for insertion into the mouth of a horse or the like during such times as a bridle with bit is worn by the horse. As pressure is applied to the bit the interior cheeks of the horse are prevented from being abraded by the rough edges of the outer vertical walls of the teeth by the depending flanges.

3 Claims, 7 Drawing Figures

MOUTHPLATE FOR HORSES OR THE LIKE

BACKGROUND AND OBJECTIVES OF THE INVENTION

Figure 1:
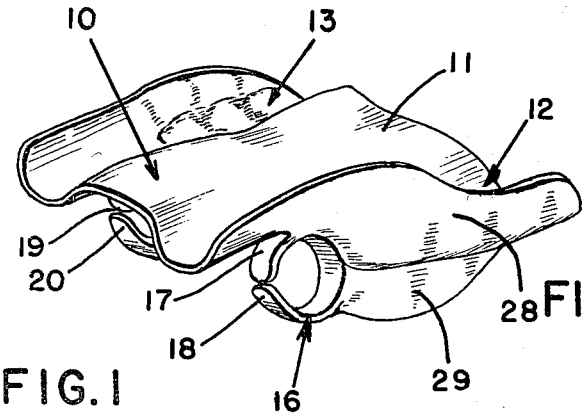

Bridles employing bits have been used for many years to guide and control animals such as horses when they are ridden and the many various types of bits have been developed through the years. As the reins are pulled by the rider the bit applies pressure to the lips and cheeks of the horse and acts as a steering mechanism. After an animal has become adjusted to the bit, normal riding may not present any problems whereas the constant abrupt turning and stopping which occurs for example in polo games can cause injury to the inside cheeks of the horse as the flesh is forced against the rough edges of the molars. To help alleviate this problem in the past it has been customary to "float" the teeth which consists of smoothing the teeth with a suitable instrument. However, this method has not proved entirely satisfactory since a horse's teeth continually grow and all the uneven spots along the top and side walls of the molars cannot be smoothed to perfection. Also, the front molars may provide a rough surface between which the cheek can be trapped and pinched when pressure is applied to the bit.

As the inside of the horse's cheeks become abraded and lacerated from constant use of the bit, infection can set in and the horse can be prevented from normally eating and thus can rapidly fall into a state of ill health.

With this background in mind the present invention was developed and one of its main objectives is to insure a healthier state for horses or other animals when bit-like devices are employed.

It is another objective of the present invention to provide a mouthplate for horses or the like in order to allow them to complete more easily without injury in contests such as polo or racing events which require a great deal of guiding, controlling, or stopping.

It is still another objective of the present invention to provide a protective device for insertion into the mouth of an animal to prevent sores, lacerations, and infections from developing therein.

It is yet another objective of the present device to provide a protective mouthplate device which is economical to manufacture and can be easily fitted to a variety of animals.

Another objective of the present invention is to provide a mouthplate protective device which will remain in position and which cannot be easily dislodged or removed by the animal.

It is another objective of the present invention to provide a mouthplate device which remains in place during long periods of use and is quite comfortable to the animal.

PREFERRED EMBODIMENT OF THE INVENTION AND DESCRIPTION OF THE DRAWINGS

The preferred embodiment of the present invention consists of a mouthplate formed of polyethylene or other suitable material and includes a central support means which fits against the roof of the horse's mouth. On each side of the support means are channels for containing the molar teeth. The outer walls of the channels form the protective area which prevents the inner cheeks and gums of the horse's mouth from being abraded by the sharp edges of the molars contained therein. The preferred embodiment of the invention also includes lower molar channels also having outer walls to protect the flesh from abrasion. Immediately in front of the lower molar channels are positioned bit securing means whereby the mouthplate can be releasably attached to the bit.

Figure 4:
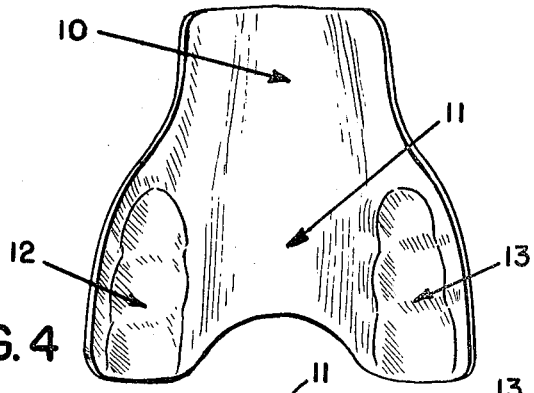
Figure 5:
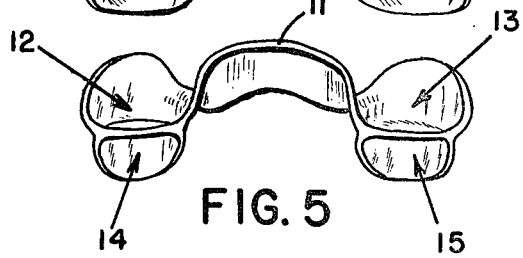
Figure 3:
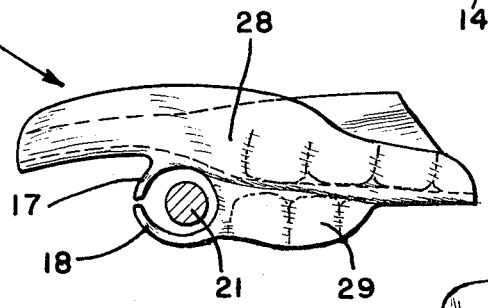
Figure 6:
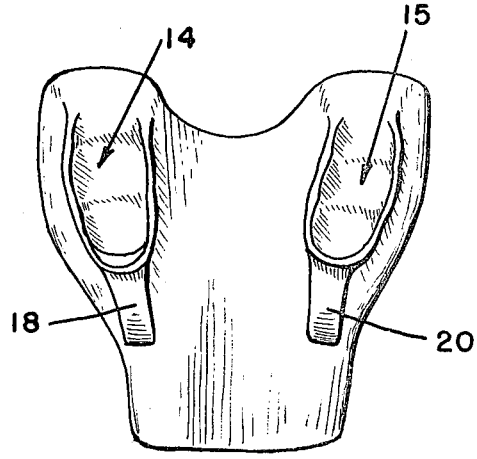
Figure 7:
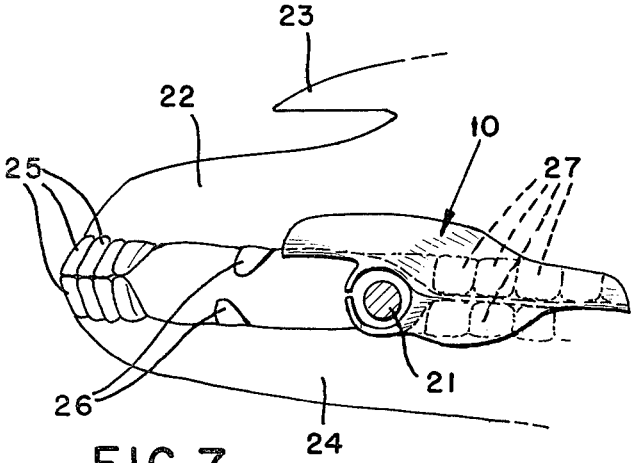
Figure 2:
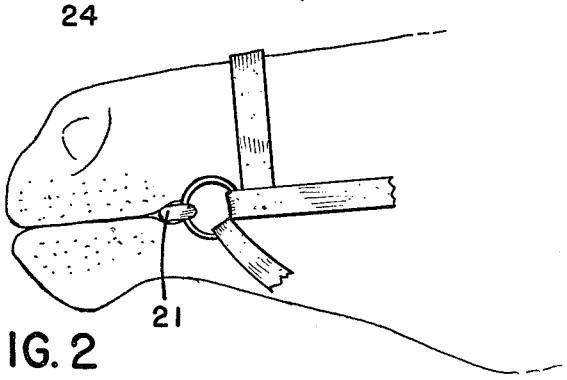

Turning now to the drawings,

FIG. 1 demonstrates a perspective view of the preferred embodiment of the invention;

FIG. 2 illustrates a bridle with bit in place on a typical horse;

FIG. 3 demonstrates a side view of the invention as shown in FIG. 1 attached to a bit;

FIG. 4 demonstrates the top view of the invention as shown in FIG. 1;

FIG. 5 demonstrates a rear view of the device shown in FIG. 4;

FIG. 6 illustrates a bottom view of the invention as shown in FIG. 5; and FIG. 7 demonstrates a view of the mouthplate as shown in FIG. 1 as it would appear in actual use.

For a more detailed description of the drawings, mouthplate 10 as shown in FIG. 1 includes a central support means 11 having upper molar channels 12 and 13. Channel 12 would receive certain of the left side molars of the horse whereas upper molar channel 13 would receive certain of the upper right side molars of the horse. Below the upper molar channels 12 and 13 are lower molar channels 14 and 15 as shown in FIG. 5 for receiving certain of the lower molars of the horse. While it is understood that the upper rows of teeth in a horse are wider than the lower rows it has been found advantageous to provide "play" in the molar channels so the mouthplate will readily adapt to a variety of individual horses having different mouth sizes.

Also shown on mouthplate 10 in FIG. 1 is bit securing means 16 having upper flexible finger 17 and lower flexible finger 18. As would be understood flexible fingers 17 and 18 on the left side and flexible fingers 19 and 20 on the right side of the mouthplate would thereby hold the bridle bit 21 in place as shown in FIG. 3 and bit 21 would be releasably attached thereto. As pressure is applied to the bit as in stopping the horse, the bit is forced against the outer walls of the molar channels of mouthplate 10 and thereby prevents the gums and interior cheeks from being forced against the outer surfaces of the molars which may be sharp and cause injury to the horse.

Polyethylene has been found to be a suitable material from which to construct the mouthplate although other materials may be used. It has been found advantageous to form the mouthplate from a somewhat flexible material to assist in its fitting to a variety of mouth sizes and shapes. Also, since some horses naturally chew the mouthplate more than others and under certain circumstances a rigid channel base composed of dense plastic or even metal may be desirable in order to provide durability for the mouthplate. The rigid channel base (not shown) would be molded or inserted into the bottom of the molar channels and could be for example affixed by a suitable adhesive.

FIG. 7 illustrates a typical mouthplate installation with a horse's skull including the maxillary bone 22, nasal bone 23 and mandible 24. Incisors 25 are shown along with canine teeth 26. Molars 27 are shown in outline form within the molar channels of mouthplate 10.

In using the present invention the mouthplate is attached to the bit of the bridle before the bridle is placed on the horse and as the bit is inserted into the horse's mouth the mouthplate is inserted simultaneously. When guiding or stopping the horse a tug on the reins forces the bit against the mouthplate and the horse then reacts to the firm pressure being applied. The outer walls of the molar channels or flanges protect the cheeks and gums from contacting the sharp edges of the contained molars. As shown in FIG. 1 upper flange member 28 and lower flange member 29 are curved and shield certain portions of the upper and lower molars respectively. As further shown in FIG. 3 upper flange member 28 shields approximately 3 upper molars and lower flange member 29 shields approximately 3 lower molars.

Various modifications and changes can be made to the invention as shown and it has been found satisfactory under certain circumstances to provide a mouthplate having a channel member for only the upper molars and it would be assumable that given the correct circumstances a mouthplate may be devised which shields only the lower molars. Also mouthplates have been designed having separate upper and lower central support means with depending flanges although the "two-piece" mouthplates have not proved as satisfactory as the embodiment illustrated in FIG. 1.

The drawings as shown are for illustrative purposes and are not intended to limit the scope of the invention.

I claim:

1. A mouthplate for insertion into the mouth of a horse or the like for use during such time as the horse wears a bridle having a bit, said mouthplate to prevent the interior cheeks of the horse from being cut or abraded by contacting rough edges of the teeth as pressure is applied to the bit, the mouthplate comprising: a support means, said support means including an inverted u-shaped portion, said u-shaped portion fitting against the roof of the mouth, said support means for positioning between certain teeth of the horse, a flange member, said flange member joined to said support means, a securing means, said securing means comprising a at least one substantially circular flexible finger member, said at least one finger member forming an opening through which a bridle bit can be releasably attached, said securing means being positioned below a portion of said support means and said support means extending forward of said flange member and forward of said securing means whereby said support means is positioned between the canine teeth and the molars of the horse.

2. A mouthplate as claimed in claim 1 and including a pair of depending flange members, one of said flange members for shielding upper teeth and the second said flange member for shielding lower teeth.

3. A mouthplate as claimed in claim 1 constructed of polyethylene.

* * * * *